US006564738B1

(12) United States Patent
Van Gemert

(10) Patent No.: US 6,564,738 B1
(45) Date of Patent: May 20, 2003

(54) SAILBOAT SPAR TRACK CLEANER

(76) Inventor: Robert W. Van Gemert, 4298 Millpond Dr., Rockford, MI (US) 49341

( * ) Notice: Subject to any disclaimer, the term of this patent is extended or adjusted under 35 U.S.C. 154(b) by 0 days.

(21) Appl. No.: 10/199,807

(22) Filed: Jul. 19, 2002

(51) Int. Cl.[7] ..... B63H 9/10
(52) U.S. Cl. ..... 114/89
(58) Field of Search ..... 114/89, 90; 15/210.1

(56) References Cited

U.S. PATENT DOCUMENTS

| | | | | |
|---|---|---|---|---|
| 50,634 | A | | 10/1865 | Sharp |
| 1,695,674 | A | | 12/1928 | Wilson |
| 4,452,164 | A | | 6/1984 | Dejager |
| 4,899,416 | A | | 2/1990 | Francis |
| 5,140,718 | A | * | 8/1992 | Toth ..... 15/210.1 |
| 5,261,143 | A | * | 11/1993 | Toth ..... 15/210.1 |
| 5,535,695 | A | | 7/1996 | Southwell |

* cited by examiner

*Primary Examiner*—Ed Swinehart
(74) *Attorney, Agent, or Firm*—Waters & Morse, P.C.

(57) ABSTRACT

A sailboat spar track cleaner for cleaning a sail track on a mast or other spar comprises a U-shaped housing that fits over the track, with adjustable track cleaners having abrasive contact surfaces extending inwardly from the sides of the housing into contact with the track. An adjustable spacer attached to a back of the U-shaped housing bears against the track and controls the position of the housing so that the track cleaning elements are properly aligned with grooves in the track. The track cleaner is mountable on a track in a sailboat and movable along the length of the track using conventional lines, such as the halyard and a downhaul in the case of a mast.

12 Claims, 4 Drawing Sheets

SAILBOAT SPAR TRACK CLEANER

BACKGROUND OF THE INVENTION

The present invention relates to a cleaning fixture for cleaning a sail track on a mast or other spar of a sailboat.

A sailboat mast, as well as other sail-supporting spars on a sailboat, is fitted with a longitudinal track in one form or another that extends the length of the mast. Sails usually have connector fixtures, such as slides, slugs, or cars, attached to the edge of the sails that interconnect the sails with the track and permit the sails to slide along the edges of the track.

A problem encountered with most sailboats is that the tracks, over a period of time, become dirty and clogged. This impairs the free movement of the sail connector on the track and makes it more difficult to raise and lower the sail. This is especially a problem in lowering a sail, wherein sails are generally lowered from a mast by means of gravity. Where the track is so clogged that the cars or connectors stick on the mast, it becomes difficult to lower the sail.

The upper portion of the track on a sailboat mast is difficult to access. There are devices that are designed to travel along the track in order to spray a lubricant on the track. However, lubricants tend to attract more grime and dirt and sometimes increase problems with track clogging. When a track is clogged in a larger sailboat, a person has to climb the mast in order to clean the track. An object of the present invention is to provide an improved sailboat track cleaner that is adjustable for different conditions and can be raised or lowered from the deck using conventional sailboat lines.

SUMMARY OF THE INVENTION

The present invention comprises a sailboat spar track cleaner for cleaning a sail track on a mast or other spar comprising a U-shaped housing that fits over the track, with adjustable track cleaners extending inwardly from the sides of the housing into contact with the track. An adjustable wheel attached to a back of the U-shaped housing bears against the track and controls the position of the housing so that the track cleaning elements are properly aligned with grooves in the track. The track cleaner is mountable on a track in a sailboat and movable along the length of the track using conventional lines, such as the halyard and a downhaul in the case of a mast.

The track cleaner elements can take different form is, depending upon the particular style and configuration of the track being cleaned. An abrasive pad can be used as the track cleaning material, so that grime is removed by abrasion and polishing the track instead of by depositing additional grime-collecting liquid on the track surface.

These and other features of the present invention are described below and shown in the appended drawings.

DETAILED DESCRIPTION OF PREFERRED EMBODIMENT

Figure 1:
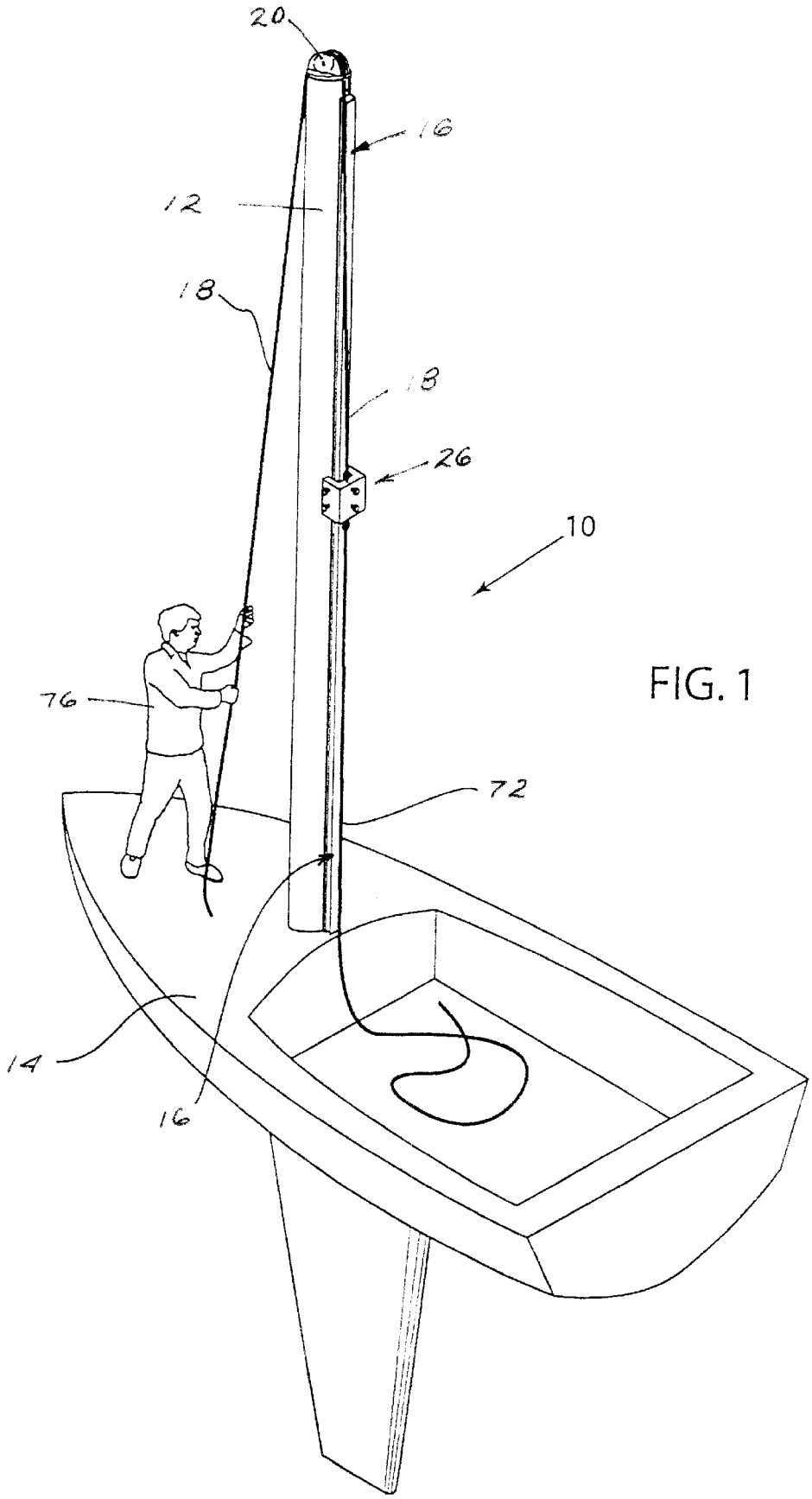
FIG. 1 is a perspective view of a sailboat employing the track cleaner of the present invention.

Referring now to the drawings, a sailboat 10 comprises a mast 12 and a hull 14. The mast includes a track 16 to which a sail is mounted by means of a connector fitting, such as a slide, slug, or a car or other conventional fitting. The sail is raised up the mast by means of a halyard line 18. The halyard extends over a pulley or block 20 at the top of the mast and then downwardly on a rear side of the mast where it connects to the upper end of the sail.

Figure 2:
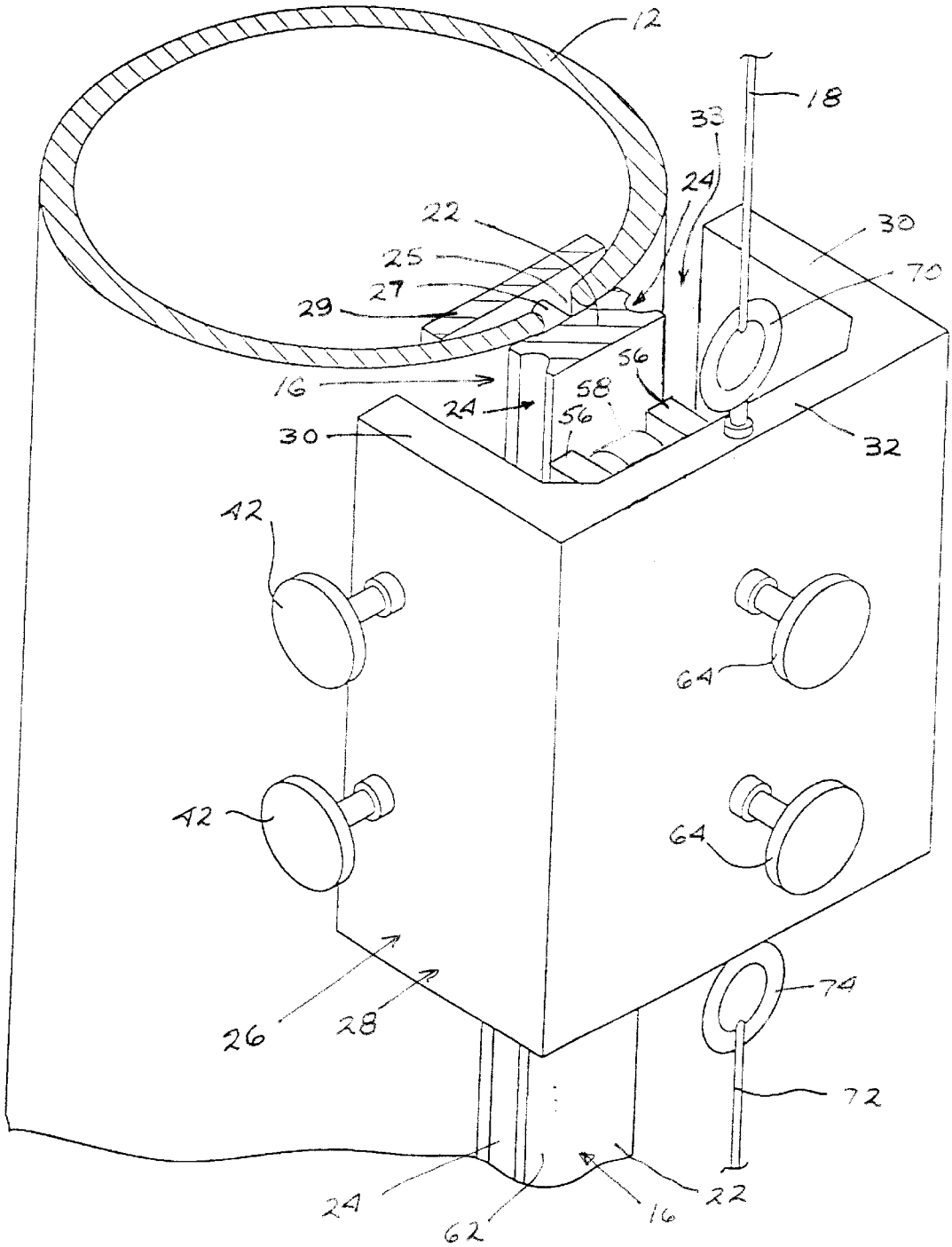
FIG. 2 is a perspective view showing the track cleaner of the present invention mounted on a sailboat mast.
Figure 3:
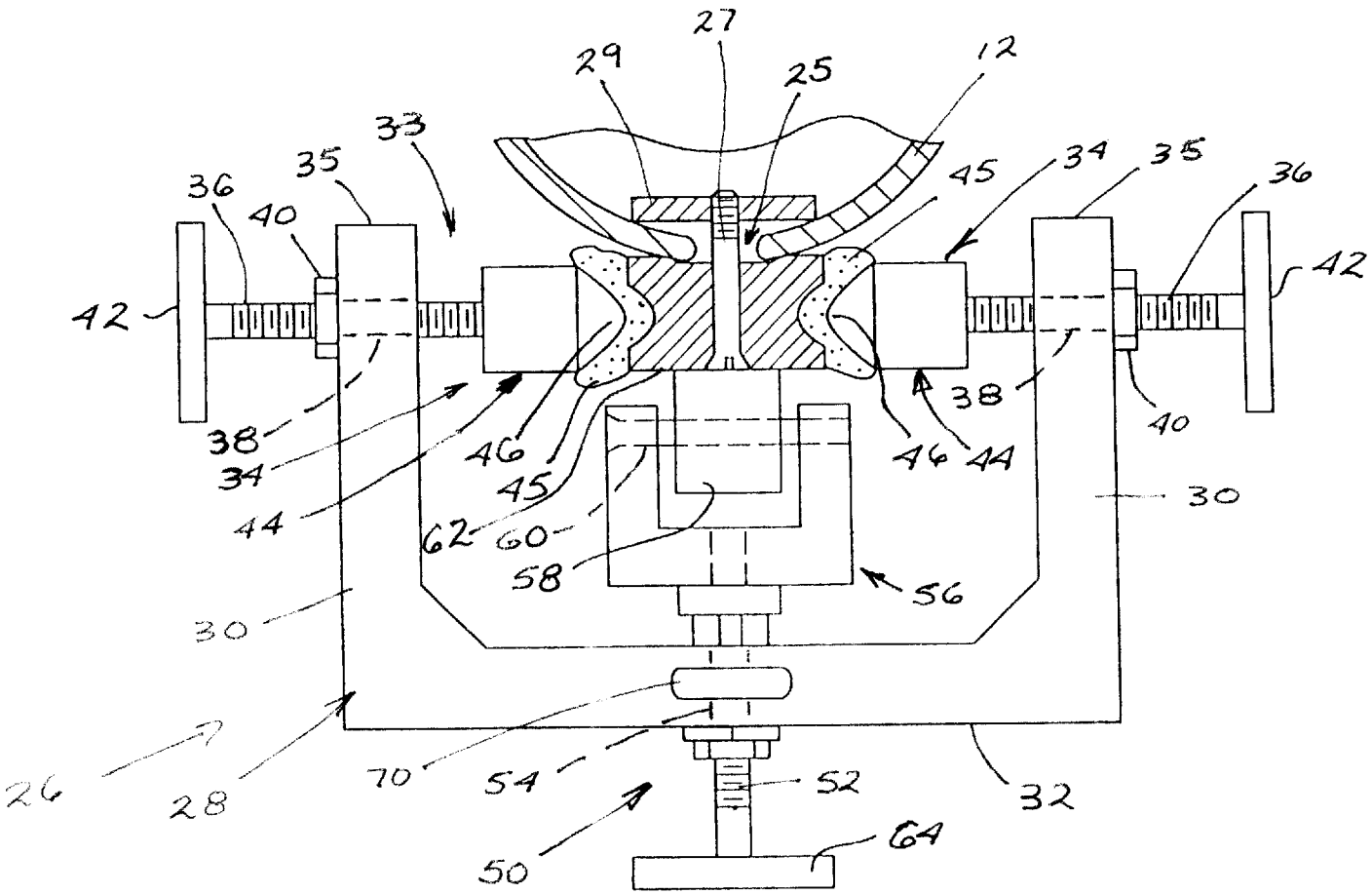
FIG. 3 is a plan view of the track cleaner of FIG. 2.

One exemplary configuration of a track on the sailboat is shown in FIGS. 2 and 3. In this type of construction, the track comprises an elongated strip 22 of metal or other suitable material, with grooves 24 being formed in opposite side edges of the track. The track is mounted over a slot 25 in mast 12 by means of screws 27 that extend through slot 25 into threaded contact with nuts 29 positioned on the inner side of the mast. Wheels or slides attached to spaced connectors along the edge of the sail ride in grooves 24 and hold the edge of the sail on the track. The accumulation of dirt and grime on the sail connector contact surfaces, such as in grooves 24, is the primary problem addressed by the present invention. These grooves are cleaned effectively by means of the track cleaner 26 of the present invention. The particular grooved track described herein is for exemplary purposes. The invention can be used with other types and shapes of tracks.

Track cleaner 26 comprises a U-shaped housing 28 having spaced sides 30, a back 32, and an open front side 33. The housing is formed of metal or other suitable material. Forward ends 35 of sides 30 of the housing fit over the grooves 24 in the outer edges of the track.

Adjustable cleaner members 34 are mounted adjacent ends 35 of the housing 28. In the preferred practice of the present invention, there are two cleaner elements spaced longitudinally along the housing.

Each cleaner element includes a threaded shaft 36 that extends through a threaded opening 38 in side 30, with a lock nut 40 serving to lock the shaft in any desired axial position. A knob 42 on the shaft is grasped for rotation of the shaft. A head piece 44 having a nose 46 thereon is threaded on the end of shaft 36. Nose 46 has a domed shape that is positioned to fit into the opposed groove 24 in track 22. Rotation of the knobs 42 bring the noses of the cleaners into juxtaposition with the grooves in the track. An abrasive material 45, such as a pad of material sold commercially as "Scotch Brite", is positioned between nose 46 and groove 24 and then the cleaner elements are moved into a light compressive or abrasive contact with the grooves in the track. The two spaced cleaner elements on each side of the housing hold the housing in vertical alignment with the track as the housing is moved upwardly and downwardly and prevent the housing from skewing into a binding position in the track.

Figure 4:
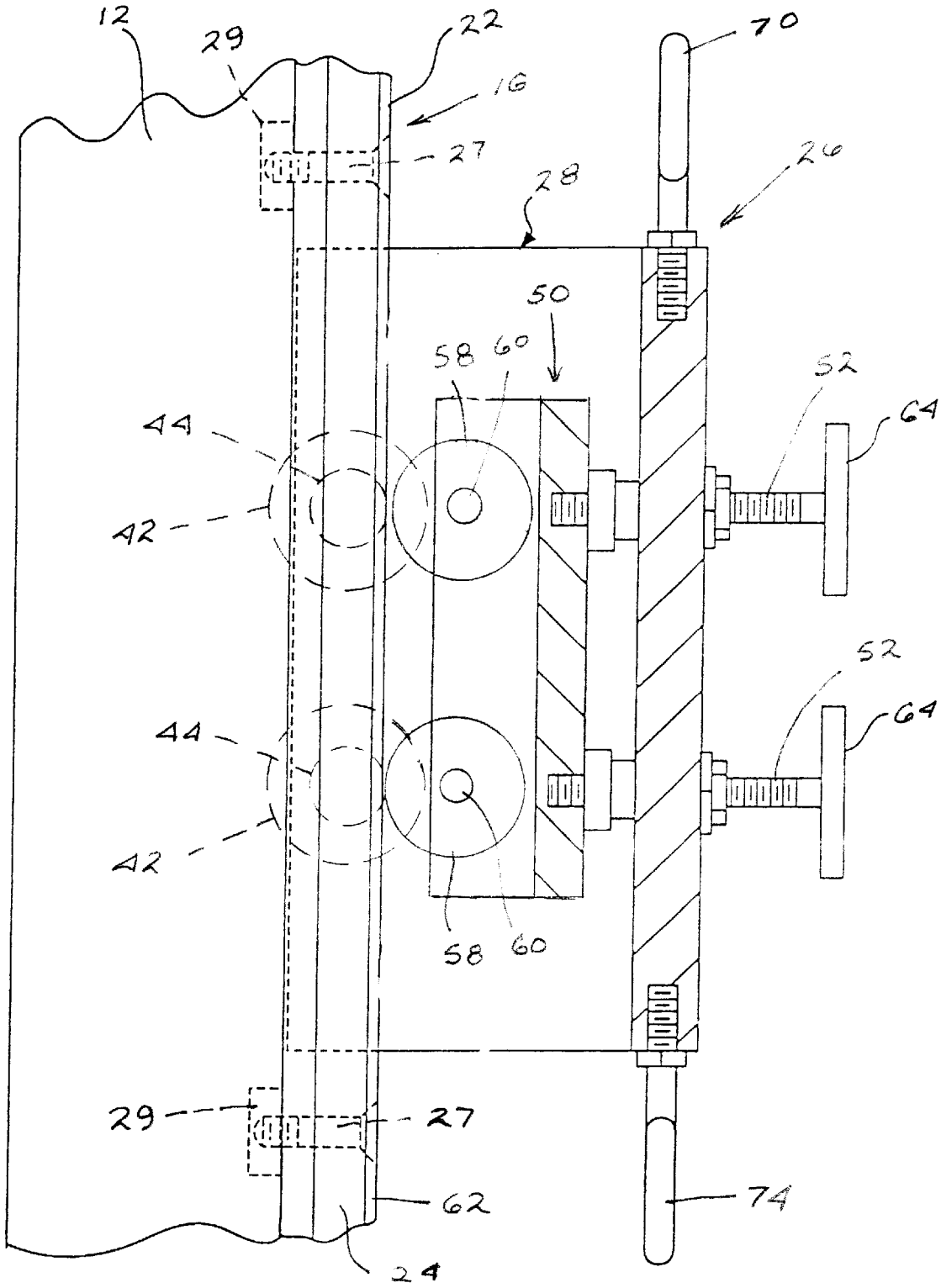
FIG. 4 is a side elevational view of the track cleaner of FIG. 2.

The track cleaner elements 34 are further maintained in proper alignment with the grooves in the track by means of an adjustable spacer mechanism 50 mounted on the back of the channel. The adjustable spacer mechanism includes at least one threaded shaft 52 that extends through a threaded opening 54 in the back of the channel. The shaft terminates in a wheel support 56 positioned at the end of shaft 52. The wheel support supports one or more wheels 58 on axles 60. The wheels are positioned in alignment with the outer surface 62 of the track and are designed to ride along the outer surface. Rotation of knob 64 on the outer end of shaft 52 causes the wheel support and attached wheel to be moved toward and away from the track in order to properly position the housing and track cleaner elements with respect to the track and the grooves in the track. As shown in FIG. 4, the wheel support 56 can be an elongated channel member wherein the axles extend across sides of the channel member. The wheel support 56 can be supported on a pair of shafts 52 that are longitudinally spaced along the back of the housing. By using a pair of support shafts 52, the proper vertical alignment of the wheel support 56 can be adjusted and maintained more effectively.

With the apparatus of the present invention, the track cleaner housing can be adjusted as desired to fit on any particular sailboat track and the elongated housing will be maintained in proper vertical alignment by the spaced track cleaners on each side of the housing and the spacer mechanism on the back of the housing.

In operation, the track cleaner is raised and lowered on the track of a mast as shown in FIG. 1. The end of halyard 18 is clipped on an eye bolt 70 at the top of the housing 28, and a downhaul line 72 is attached to an eye bolt 74 at a lower end of housing 28. A person 76 can then raise the track cleaner up the track by pulling on the halyard, as shown in FIG. 1, and then he can lower the track cleaner on the track by pulling downhaul 72 downward. This action can be repeated until the track is cleaned and buffed as desired. The clean track will let the wheels or slide of the sail connector travel smoothly upwardly and downwardly along the track without the use of dirt collecting lubricants.

It should be understood that various modifications of the arrangements and details of construction of the present invention may be made without departing from the spirit and scope of the present invention.

I claim:

1. A sailboat track cleaner for cleaning a sail track on a mast, wherein the sail track runs along the mast and includes oppositely facing sides on which sail connector fittings attached along the edge of the sail are movably mounted for longitudinal movement along the track, the sail track cleaner comprising:

a U-shaped housing having a back and spaced sides, the housing having an open front that is adapted to be positioned over the track, the sides being positioned so as to be spaced outwardly from sides of the track, the back of the housing being adapted to be positioned so as to be spaced outwardly from a front of the track;

adjustable cleaner members mounted on the sides of housing, the cleaner members including a track cleaner head adjustably mounted on an inner side of each side of the housing for movement toward and away from the opposite side of the housing, the track cleaner heads having noses with abrasive thereon that are shaped to engage and abrade sail contact surfaces on the sides of the track as the track cleaner is reciprocated along the track; and an adjustable spacer extending between the back of the housing and a front surface of the track, the spacer including:

an inner channel member having a back and spaced sides and an open front facing the open front of the housing;

at least one wheel rotatably mounted in the inner channel for rotation about an axis extending between the inner channel sides, the wheel having a peripheral surface that extends outwardly from the open front of the inner channel;

an adjustable support mechanism extending between the housing and inner channel, the adjustable support mechanism suspending the inner channel in the housing, the adjustable support mechanism being adjustable to vary the distance between the inner channel and the back of the housing.

2. A sailboat spar track cleaner for cleaning opposed sail connector contact surfaces in a spar track, comprising:

a U-shaped housing having a back, spaced sides, and an open front, the open front fitting on opposite sides of the track;

a pair of track cleaner elements mounted in opposed sides of the housing and extending inwardly therefrom, the track cleaner elements being adjustably mounted for movement in inward and outward directions, the elements having noses with abrasive material at least removably affixed thereon, the cleaner elements being adjustable until the noses frictionally engage the sail connector contact surfaces on opposite sides of the track; and a connector for attaching lines to the housing from opposite longitudinal directions on the spar, such that the cleaner can be reciprocated along the track by alternately pulling the lines in the opposite directions, whereby the track is cleaned by reciprocation of the cleaner along the track while the cleaning elements are in abrasive contact with the track.

3. A spar track cleaner according to claim 2 and further comprising an adjustable spacer for adjusting the inward and outward position of the housing with respect to the track so that the cleaning elements are aligned with the connector contact surfaces on the track.

4. A spar track cleaner according to claim 3 wherein the spacer comprises at least one rotatable wheel adjustably connected to the back of the housing for movement toward and away from the open front of the housing.

5. A spar track cleaner according to claim 4 wherein the wheel is mounted in a U-shaped bracket, with the bracket having a back that is attached to an adjustment bolt, the adjustment bolt extending through a threaded opening in the back of the housing, the bolt being rotatable to axially displace the shaft and move the wheel toward and away from the track.

6. A spar track cleaner according to claim 5 wherein the cleaner includes at least two track cleaner elements spaced longitudinally on at least one side of the housing and at least two adjustable spacer wheels spaced longitudinally on the back of the housing.

7. A spar track cleaner for cleaning sail connector contact surfaces on opposite sides of a spar track, comprising:

a housing;

a pair of laterally spaced track cleaner elements mounted to the housing for relative lateral movement toward and away from each other, the track cleaner elements including spaced abrasive noses that are shaped and positioned to frictionally engage the sail connector contact surfaces on the sail track;

an adjustment mechanism that adjusts relative positions of the track cleaner elements with respect to the sail connector contact surfaces so as to provide a desired frictional contact between the noses and the contact surfaces;

at least one connector for connecting sailboat lines to the housing for reciprocating the housing along the track.

8. A spar track cleaner as in claim 7 wherein the noses include a removable abrasive material that can be replaced from time to time.

9. A spar track cleaner as in claim 7 wherein the adjustment mechanism comprises a threaded shaft mounted in a nut wherein relative rotation of the shaft with respect to the nut adjusts the position of the noses with respect to each other.

10. A spar track cleaner as in claim 7 wherein the spar track cleaner includes two pairs of laterally spaced track cleaner elements longitudinally spaced from each other in the direction of the spar track, each pair being separately position adjustable.

11. A spar track cleaner as in claim 7 wherein the abrasive noses of the track cleaner elements are positioned in a plane that is alignable with the spar track sail contact surfaces, with the spar track cleaner further including an adjustable spacer for positioning the adjustable noses in the plane of the sail connector contact surfaces when the housing is moved into abutting engagement with the spar track.

12. A spar track cleaner as in claim 11 wherein the adjustable spacer includes a rotatable wheel that is adjustably mounted in the housing between and to the side of the track cleaner elements for rotation in a plane perpendicular to a line between the noses on the track cleaner elements, the position of the wheel being adjustable toward and away from the noses.

* * * * *